US010211501B2

(12) United States Patent
Weiß

(10) Patent No.: US 10,211,501 B2
(45) Date of Patent: Feb. 19, 2019

(54) HIGH-FREQUENCY FILTER WITH DIELECTRIC SUBSTRATES FOR TRANSMITTING TM MODES IN TRANSVERSE DIRECTION

(71) Applicant: KATHREIN-WERKE KG, Rosenheim (DE)

(72) Inventor: Frank Weiß, Großkarolinenfeld (DE)

(73) Assignee: Kathrein SE, Rosenheim (DE)

( * ) Notice: Subject to any disclaimer, the term of this patent is extended or adjusted under 35 U.S.C. 154(b) by 208 days.

(21) Appl. No.: 15/142,364

(22) Filed: Apr. 29, 2016

(65) Prior Publication Data

US 2016/0322688 A1 Nov. 3, 2016

(30) Foreign Application Priority Data

Apr. 30, 2015 (DE) ..... 10 2015 005 523

(51) Int. Cl.
*H01P 1/208* (2006.01)
*H01P 1/202* (2006.01)
(Continued)

(52) U.S. Cl.
CPC ..... *H01P 1/2084* (2013.01); *H01P 1/202* (2013.01); *H01P 5/02* (2013.01); *H01P 5/022* (2013.01); *H01P 7/04* (2013.01); *H01P 7/06* (2013.01)

(58) Field of Classification Search
CPC ..... H01P 1/213; H01P 1/2133; H01P 1/2138; H01P 1/2084; H01P 7/04; H01P 1/202; H01P 7/06; H01P 5/02; H01P 5/022
(Continued)

(56) References Cited

U.S. PATENT DOCUMENTS 4,267,537 A 5/1981 Karmel
4,721,933 A * 1/1988 Schwartz ..... H01P 1/2082 333/209
(Continued)

FOREIGN PATENT DOCUMENTS

| | | |
|---|---|---|
| DE | 195 47 006 C2 | 6/1996 |
| DE | 198 47 006 | 4/2000 |
| DE | 697 22 570 T2 | 4/2004 |
| WO | 2014/128484 A1 | 8/2014 |

OTHER PUBLICATIONS

Chen, Ming Hui, "Short-Circuit Tuning Method for Singly Terminated Filters," IEEE Transactions on Microwave Theory and Techniques, vol. MTT-25, No. 12, Dec. 1977, pp. 1032-1036, XP55335299A.
(Continued)

*Primary Examiner* — Rakesh Patel
(74) *Attorney, Agent, or Firm* — Nixon & Vanderhye P.C.

(57) ABSTRACT

A high-frequency filter consists of a housing, which includes resonators, each of which has at least one dielectric. The n resonators are arranged along a central axis. The n resonators are isolated from one another by at least n−1 isolation devices. The n−1 isolation devices have coupling openings, through which a coupling is established at a right angle to or with one component predominantly at a right angle to the H field. A first signal line terminal is inserted into the first resonator chamber through a first opening in the housing and is in contact with the respective dielectric there. In addition or alternatively, a second signal line terminal is inserted into the $n^{th}$ resonator chamber through a second opening in the housing and is in contact with the respective dielectric there.

18 Claims, 12 Drawing Sheets

(51) Int. Cl.

| | |
|---|---|
| ***H01P 5/00*** | (2006.01) |
| ***H01P 7/04*** | (2006.01) |
| ***H01P 7/06*** | (2006.01) |
| ***H01P 5/02*** | (2006.01) |

(58) Field of Classification Search
USPC ..... 333/135, 137, 208, 209, 212
See application file for complete search history.

(56) References Cited

U.S. PATENT DOCUMENTS

| | | | |
|---|---|---|---|
| 4,881,051 | A | 11/1989 | Tang et al. |
| 5,576,674 | A | 11/1996 | Jachowski |
| 5,764,115 | A | 6/1998 | Hattori et al. |
| 6,072,378 | A | 6/2000 | Kurisu et al. |
| 6,549,092 | B1 | 4/2003 | Hattori et al. |
| 6,714,096 | B1 | 3/2004 | Broad et al. |
| 2002/0041221 | A1 | 4/2002 | Abdulnour |
| 2003/0011444 | A1 | 1/2003 | Wang |
| 2014/0091878 | A1 | 4/2014 | Bila et al. |

OTHER PUBLICATIONS

Dishal, Milton, "Alignment and Adjustment of Synchronously Tuned Multiple-Resonant-Circuit Filters," Proceedings of the I.R. E., Nov. 1951, pp. 1448-1455, XP11153349A.

Ness, John B., "A Unified Approach to the Design, Measurement, and Tuninng of Coupled-Resonator Filters," IEEE Transactions on Microwave Theory and Techniques, vol. 46, No. 4, Apr. 1998, pp. 343-351, XP11037127A.

Pepe, Giuseppe, et al., "Sequential Tuning of Microwave Filters Using Adaptive Models and Parameter Extraction," IEEE Transactiuons on Microwave Theory and Techniques, vol. 53, No. 1, Jan. 2005, pp. 22-31, XP11125348A.

Höft et al., "Compact Base-Station Filters Using TM-Mode Dielectric Resonators", Jan. 2006, 4 pages.

Höft, Michael, et al., "Compact Combline Filter with improved Cross Coupling Assembly and Temperature Compensation," Proceedings of Asia-Pacific Microwave Conference, 2006, 4 pages.

Kobayashi, Yoshio, et al., "Bandpass Filters Using Electrically-Coupled TM010 Dielectric Rod Resonators," Electronics and Communications in Japan, vol. 66-B, No. 3, 1983, pp. 33-42.

Pelliccia, Luca, et al., "Ultra-compact Pseudoelliptic Waveguide Filters Using TM Dual-Mode Dielectric Resonators," Proceedings of the Asia-Pacific Microwave Conference, 2011, pp. 143-146.

Ishikawa, Youhei, et al., "1.9 GHz Compact Love Loss Dielectric Duplexer Designed by Dual Mode Waveguide Transmission Line Method", Sep. 5, 1994, pp. 1179-1184, XP 000678211.

Kobayoshi, Yoshio, et al., "Bandpass Filters Using Electrically-Coupled TM010 Dielectric Rod Resonators", Electronics & Communications in Japan, 1983, vol. 66-B, No. 3, pp. 33-42, XP-001402070.

* cited by examiner

HIGH-FREQUENCY FILTER WITH DIELECTRIC SUBSTRATES FOR TRANSMITTING TM MODES IN TRANSVERSE DIRECTION

CROSS-REFERENCE TO RELATED APPLICATIONS

This application claims priority from German Patent Application No. 10 2015 005 523.2 filed Apr. 30, 2015, incorporated herein by reference.

STATEMENT REGARDING FEDERALLY SPONSORED RESEARCH OR DEVELOPMENT

None.

FIELD

The technology herein relates to a high-frequency filter suitable in particular for transmitting TM modes in transverse direction.

BACKGROUND

When referring to the transmission of TM modes and/or TM waves, only the electric field has components in the direction of propagation and the magnetic fields are situated only in the plane perpendicular to the direction of propagation. TM waves are therefore also referred to as E waves.

U.S. Pat. No. 6,549,092 B1 discloses a high-frequency filter comprising a plurality of resonator chambers interconnected through openings. Each resonator chamber contains a dielectric material and an internal conductor, wherein the internal conductor is designed in one piece with the housing. The internal conductor is energized by means of a feeder line by means of which the dielectric material is also energized. The complex design is a disadvantage of this high-frequency filter, which necessarily results in greater deviations in the filter properties during production.

The publication "Compact Base Station Filters Using TM Mode Dielectric Resonators" by M. Höft and T. Magath describes the structure of a high-frequency filter having a plurality of dielectric resonators. The coupling between the individual resonators is in parallel to the direction of propagation of the H field.

It is a disadvantage of this design that it requires more space to be able to implement the desired filter properties. The space required increases as more signal transmission paths are to be formed.

The example non-limiting technology herein creates a high-frequency filter, which is suitable in particular for transmission of TM modes in transverse direction. This high-frequency filter has a space-saving design, on the one hand, while being simple and inexpensive to manufacture, on the other hand.

The example technology provides a high-frequency filter and method for adjusting such a high-frequency filter.

The high-frequency filter comprises at least n resonators, each of which has a resonator chamber enclosed by the housing, where $n \geq 2$, preferably $n \geq 3$, more preferably $n \geq 4$, even more preferably $n \geq 5$. The high-frequency filter also has at least n dielectrics, at least one of which is arranged in one resonator chamber of the n resonators. The resonator channels of the n resonators are arranged against one another in the direction of signal transmission, where the direction of signal transmission runs at a right angle to or primarily at a right angle to the H field. Each resonator chamber is adjacent to at most two other resonator chambers and is isolated from each of the other resonator chambers by one of n−1 isolation devices. Each of the n−1 isolation devices has at least one coupling opening, wherein adjacent resonator chambers are coupled to one another exclusively by means of these coupling openings in the corresponding isolation device. The coupling between the resonator chambers is at a right angle or with one component predominantly at a right angle to the H field. A first signal line terminal is coupled through a first opening in the housing, in particular in the housing cover, to the at least one dielectric of the first resonator, wherein a) the first signal line terminal is in central or eccentric contact with the dielectric in the resonator chamber of the first resonator;
   or
b) the dielectric has a recess in the resonator chamber of the first resonator into which the first signal line terminal protrudes;
   or
c) the dielectric in the resonator chamber of the first resonator has a continuous recess through which the first signal line terminal comes in contact with the first isolation device.

Additionally or alternatively, this is also true of the second signal line terminal, which protrudes into the $n^{th}$ resonator chamber. This one is coupled to the dielectric of the $n^{th}$ resonator through a second opening in the housing, in particular in the housing bottom, wherein a) the second signal line terminal is in central or eccentric contact with the dielectric in the resonator chamber of the $n^{th}$ resonator;
   or
b) the dielectric in the resonator chamber of the $n^{th}$ resonator has a recess into which the second signal line terminal protrudes;
   or
c) the dielectric in the resonator chamber of the $n^{th}$ resonator has a continuous recess through which the second signal line terminal extends, so that the second signal line terminal is in contact with the $n-1^{th}$ isolation device.

Due to the fact that the coupling takes place at a right angle to the H field in particular, the resonator may also have a compact design. In addition, very good filter results are achieved because the dielectric which is directly in contact with the signal line terminal is energized directly by it. This energization does not take place indirectly due to the fact that the TM wave first propagates in the cavity of the resonator and optionally also energizes an internal conductor, by means of which the dielectric is then energized to oscillation.

The first signal line terminal and/or the second signal line terminal is/are preferably in contact with the first and/or $n^{th}$ dielectric and/or with the first and/or $n-1^{th}$ isolation device, being arranged perpendicular to the surface of the isolation device and/or parallel to a central axis which passes through the high-frequency filter and all the resonator chambers.

It is also advantageous in particular if the first signal line terminal, which engages in the indentation or in the continuous recess in the dielectric in the resonator chamber of the first resonator, is in contact with this dielectric or is arranged in this dielectric in a non-contact arrangement. The same is preferably also true of the second signal line terminal. In a non-contact arrangement, there is less coupling, but the assembly is simpler.

An example non-limiting method for adjusting the high-frequency filter comprises various process steps. In one process step, at the beginning all the coupling openings of the $1+X^{th}$ isolation device and/or the $n-1-X^{th}$ isolation device are closed, where X is equal to 0 at the beginning. In another process step a reflection parameter is measured on the signal line terminal and/or on at least one, preferably all the signal line terminals. In addition, the resonant frequency and/or the coupling bandwidth and/or the input bandwidth is/are set at a desired level. With this method, the resonant frequency and/or the coupling bandwidth of m resonator chambers of a resonator chamber can be set at the desired level independently of additional resonator chambers in other resonator chambers.

Another advantage is achieved when one or both end faces of each of the n dielectrics is/are covered with a metal layer, wherein this metal layer is then one of the n−1 isolation devices and wherein at least one recess within the metal layer forms the at least one coupling opening. The use of suitably coated dielectrics allows a further reduction in the size of the high-frequency filter.

The housing preferably comprises a housing bottom and a housing cover at a distance from the housing bottom. Between the housing bottom and the housing cover:

a) a peripheral housing wall is arranged; or b) at least one insert and one peripheral housing wall are arranged, the insert being enclosed by the peripheral housing wall, which also forms the outside wall of the high-frequency filter; or c) at least one insert is arranged, forming a housing wall.

For the case when only one, preferably n inserts are used, the filter may have a very compact design. Then the n−1 isolation devices may be situated between the inserts. The lateral peripheral surfaces of the inserts as well as the lateral peripheral surface of the n−1 isolation devices form the peripheral wall of the housing in the embodiment variant c). In the embodiment variant b), in which the at least one insert is surrounded by a peripheral housing wall, the high-frequency filter has a very stable design.

Another advantage of the example non-limiting high-frequency filter is also when the diameter of at least one, preferably all the resonator chambers, is/are defined and/or predetermined by at least one insert, in particular by an annular insert, which leans against the housing wall. Therefore, the resonant frequency can be adjusted. The leaning of the insert on housing wall, in particular in a form-fitting manner, also ensures that the insert cannot be displaced out of its position over time.

Another advantage of the example non-limiting high-frequency filter is obtained when the inserts of at least two n resonator chambers that do not follow one another directly, i.e., are not adjacent to one another, have an opening, wherein the at least two openings are connected to one another by a duct, which runs at least partially inside the housing wall, for example. An electric conductor runs in this duct, wherein the electric conductor couples the two resonator chambers of the different resonator chambers capacitively and/or inductively to one another. In this way, despite the compact design of the high-frequency filter, it is possible to achieve a cross-coupling between two resonators not directly adjacent to one another.

The n dielectrics may be disk-shaped inside the high-frequency filter and/or all or some of the n dielectrics may be completely different or partially different in their dimensions. It is also possible for all or at least one of the n dielectrics to fill up some or all of the volume of its/their respective resonator chamber and thus the m resonator chambers. Due to the geometric design and the arrangement of the dielectrics, the behavior of each resonator with respect to its resonator frequency and its coupling bandwidth can be adjusted accordingly.

The coupling between the individual resonators is increased if the dielectric in the first resonator is in contact with the first isolation device and the dielectric in the $n^{th}$ resonator is in contact with the $n-1^{th}$ isolation device wherein the other dielectrics in the remaining n−2 resonators are in contact with both isolation devices adjacent to the respective resonator chamber. It is particularly advantageous if the dielectric in the $n^{th}$ resonator is in contact with the housing bottom when the dielectric in the first resonator is also in contact with the housing cover. The phrase "to be in contact with" is understood to mean that two structures at least touch one another. The dielectrics of the n resonator chambers are preferably fixedly connected to the respective isolation device or the respective isolation devices, so that the coupling is improved.

Another advantage of the high-frequency filter is that the arrangement and/or size and/or cross-sectional shape of at least one coupling opening of one of the n−1 isolation devices differs completely or partially from the arrangement and/or size and/or cross-sectional shape of one of the other ones of the n−1 isolation devices. It is also possible for the number of coupling openings in the n−1 isolation devices to be completely or partially different from one another. The coupling between the individual resonators can therefore be set at the desired level.

For further tuning of the high-frequency filter, it is also possible for the at least one, preferably all the resonator chambers of at least one, preferably all resonator chambers to have at least one additional opening toward the outside of the housing, wherein at least one tuning element can be inserted into the resonator chamber of at least one resonator chamber through this additional opening. The distance between the tuning element, which is inserted into the at least one resonator chamber of at least one resonator chamber through the at least one additional opening, and the corresponding dielectric can be altered to the corresponding respective dielectric inside the at least one resonator chamber in the at least one resonator chamber. A plurality of tuning elements may also be inserted into a resonator chamber, wherein one tuning element may consist entirely of a metal or a metallic coating, whereas the other tuning element consists of a dielectric material, for example. The tuning element that is made of a metallic material may be used for approximate tuning and the tuning element that is made of a dielectric material may be used for fine tuning of the resonant frequency and/or of the coupling bandwidth of the corresponding resonator.

The distance between the at least one spacer element and the respective dielectric within the resonator chamber can also be reduced to such an extent that it is in direct contact with the latter. The dielectric of each resonator chamber may also have at least one indentation, wherein the distance between the tuning element and the dielectric can be reduced to such an extent that the tuning element is inserted into the indentation in the respective dielectric and is thereby in contact with it. The tuning element is inserted into the resonator chamber at a right angle to the signal transmission direction in particular.

The method for adjusting the high-frequency filter is repeated accordingly for the other resonator chambers. After the resonant frequency and/or the coupling bandwidth of the first and/or last resonator chamber, i.e., the $n^{th}$ resonator chamber, has been set, then in an additional process step, at least one coupling opening of the $1+X^{th}$ isolation device and/or of the $n-1-X^{th}$ isolation device is opened. In addition, the value of the counter variable X is incremented by 1. Next, the previous process steps are carried out again. A reflection factor is measured on the first signal line terminal and/or a reflection factor on the second signal line terminal, is measured. Following that, the coupling openings to the next resonators in the next resonator chamber are opened and the value of the counter variable is incremented again. The adjustment of the high-frequency filter begins with the resonators, in which the signal line terminals engage, i.e., with the outermost resonators, and it ends with the resonator or the resonators at the center of the high-frequency filter.

For the case when the high-frequency filter has an odd number of resonator chambers, the resonator at the center of the high-frequency filter must be used once for measurement of the reflection factor on the first signal line terminal and another time for the measurement of the reflection factor on the second signal line terminal. The coupling openings of the two isolation devices surrounding the resonator at the center of the high-frequency filter must be closed with respect to the other signal line terminal, depending on the measurement of the respective reflection factor.

Following that, or when all the coupling openings have been opened in the case of an even number of resonators, the forward transmission factor and/or the reverse transmission factor must also be measured on the first signal line terminal and/or on the second signal line terminal, in addition to measuring the reflection factors.

The resonant frequencies and/or the coupling bandwidths can be changed for each resonator by changing the diameter of the resonator chamber, which is possible, for example, by replacing the at least one insert with one other insert having different dimensions, for example. The arrangement and/or number and/or size and/or cross-sectional shape of the at least one coupling opening can also be altered by rotation and/or replacement of the at least one isolation device. Tightening or loosening at least one tuning element and at least one resonator chamber of a resonator chamber also makes it possible to alter the resonant frequency and/or the coupling bandwidth. Finally, the dielectric in the resonator chamber can also be replaced by another dielectric having different dimensions.

BRIEF DESCRIPTION OF THE DRAWINGS

Various exemplary embodiments of the invention are described below reference to the drawings as examples. The same objects have the same reference numerals. The corresponding figures show in detail.

DETAILED DESCRIPTION OF EXAMPLE NON-LIMITING EMBODIMENTS

Figure 1:
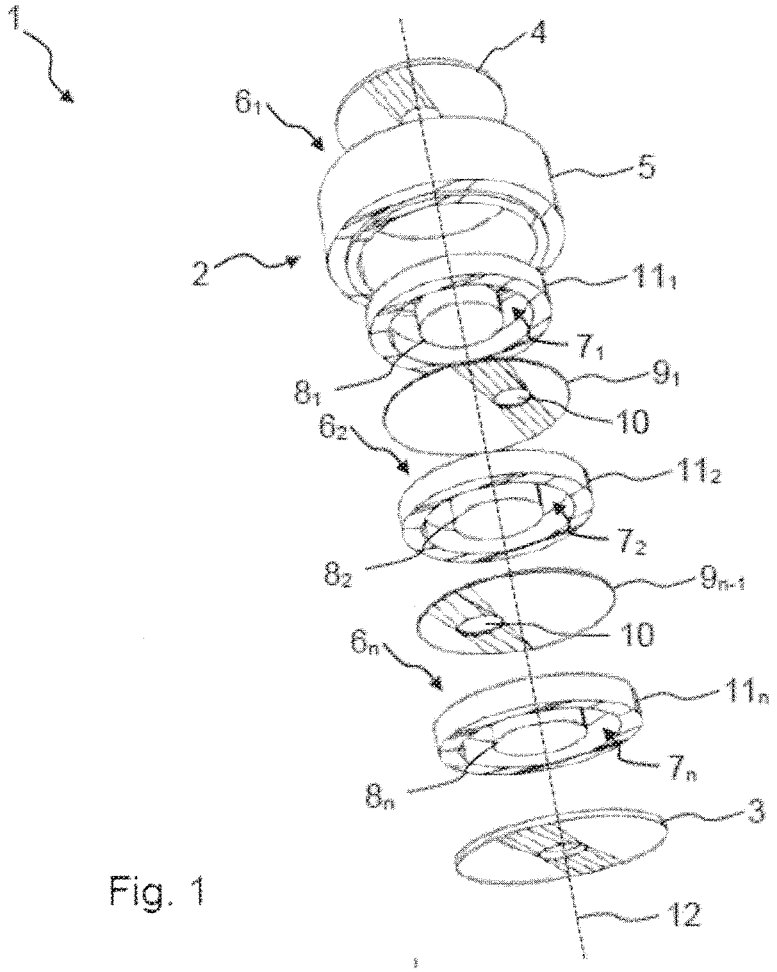
FIG. 1 an exploded drawing of an example non-limiting high-frequency filter.

FIG. 1 shows an exploded diagram of an exemplary embodiment of the high-frequency filter 1. The high-frequency filter 1 comprises a housing 2, which has a housing bottom 3 and a housing cover 4 at a distance from the housing bottom 3 and a housing wall 5 running peripherally between the housing bottom 3 and the housing cover 4. The housing cover 4 and the housing bottom 5 have at least one opening through which a signal line terminal $\mathbf{30}_1$, $\mathbf{30}_2$ can be inserted, as will be presented later. A first signal line terminal $\mathbf{30}_1$ is passed through the opening of the housing cover 4 to the high-frequency filter 1, and a second signal line terminal $\mathbf{30}_2$ is passed through the opening in the housing bottom 3. The openings in the housing cover 4 and in the housing bottom need not be arranged at the center of the housing bottom 3 or the housing cover 4. It is also possible for the openings to be arranged eccentrically. Preferably both the housing cover 4 and the housing bottom 3 to be removed. In the installed state of the high-frequency filter 1, the housing cover 4 and the housing bottom 3 are preferably bolted to the peripheral housing wall 5.

The high-frequency filter 1 also has a plurality of resonators $\mathbf{6}_1$, $\mathbf{6}_2$, . . . , $\mathbf{6}_n$, each of the n resonators $\mathbf{6}_1$, $\mathbf{6}_2$, . . . , $\mathbf{6}_n$ comprising at least one resonator chamber $\mathbf{7}_1$, $\mathbf{7}_2$, . . . , $\mathbf{7}_n$, where n is a natural number, $n \geq 1$.

Inside each resonator chamber $\mathbf{7}_1$, $\mathbf{7}_2$, . . . , $\mathbf{7}_n$, there is at least one dielectric $\mathbf{8}_1$, $\mathbf{8}_2$, . . . , $\mathbf{8}_n$. This dielectric $\mathbf{8}_1$, $8_2, \ldots, 8_n$ is preferably designed in the form of a disk or cylinder, which extends over the entire volume of the respective resonator chamber $7_1, 7_2, \ldots, 7_n$ or over only a portion thereof.

The individual resonator chambers $7_1, 7_2, \ldots, 7_n$ are isolated from one another by isolation devices $9_1, 9_2, \ldots, 9_{n-1}$. These isolation devices $9_1, 9_2, \ldots, 9_{n-1}$ are preferably isolation panels. These isolation devices $9_1, 9_2, \ldots, 9_{n-1}$ are each made of an electrically conductive material or they are coated with such a material. Each of these isolation devices $9_1, 9_2, \ldots, 9_{n-1}$ has at least one coupling opening 10. The size, geometric shape, number and arrangement of the coupling opening 10 within the respective isolation device $9_1, 9_2, \ldots, 9_{n-1}$ may be selected as desired and may differ from one isolation device $9_1, 9_2, \ldots, 9_{n-1}$ to another isolation device $9_1, 9_2, \ldots, 9_{n-1}$. For example, the diameter of the coupling openings 10 amounts to only a fraction of a millimeter, depending on the frequency range. It may also amount to several millimeters, in particular at low frequencies. The isolation devices $9_1, 9_2, \ldots, 9_{n-1}$ are preferably thinner than the dielectrics $8_1, 8_2, \ldots, 8_n$. The isolation devices $9_1, 9_2, \ldots, 9_{n-1}$ are preferably only a few millimeters thick, preferably being thinner than 3 millimeters, more preferably being thinner than 2 millimeters.

The isolation devices $9_1, 9_2, \ldots, 9_{n-1}$ and the housing 2 are each designed as isolated components that are separate from one another. The isolation devices $9_1, 9_2, \ldots, 9_{n-1}$ are completely surrounded by the peripheral housing wall 5 of the high-frequency filter in the installed state of the high-frequency filter 1 and are arranged only and exclusively in the interior of the high-frequency filter 1. They are preferably not bolted to the housing 2. The isolation devices $9_1, 9_2, \ldots, 9_{n-1}$ can be inserted when the housing cover 4 is open and/or the housing bottom 3 is open. This means that they are not part of the outside wall of the high-frequency filter 1. In one embodiment of the invention, the isolation devices $9_1, 9_2, \ldots, 9_{n-1}$ lie on the respective dielectrics $8_1, 8_2, \ldots, 8_n$ and are preferably supported only by means of them on the housing bottom 3 and/or on the housing cover 4 of the high-frequency filter 1.

Each resonator chamber $7_1, 7_2, \ldots, 7_n$ may also include at least one insert $11_1, 11_2, \ldots, 11_n$. Such an insert $11_1, 11_2, \ldots, 11_n$ is preferably a ring, which is supported with its outside surface on an inside surface of the housing wall 5, preferably in a form-fitting manner. Such an insert $11_1, 11_2, \ldots, 11_n$, which is electrically conductive, can be used to adjust the volume of the resonator chamber $7_1, 7_2, \ldots, 7_n$ and thus to adjust the resonant frequency.

The housing 2 of the high-frequency filter 1 is preferably kept free of internal conductors, which are galvanically connected to the housing 2 at one end.

In the exemplary embodiment from FIG. 1, a central axis 12 is also shown, running through the high-frequency filter 1. The signal transmission direction 21 corresponds to the central axis 12. The resonators $6_1, 6_2, \ldots, 6_n$ are arranged one above the other. Each resonator $6_1, 6_2, \ldots, 6_n$ therefore has at most two directly adjacent resonators $6_1, 6_2, \ldots, 6_n$, wherein the resonators $6_1, 6_2, \ldots, 6_n$ are isolated from one another by the respective isolation devices $9_1, 9_2, \ldots, 9_{n-1}$. Coupling of the individual resonators $6_1, 6_2, \ldots, 6_n$ is possible only through the respective coupling openings 10 inside the isolation devices $9_1, 9_2, \ldots, 9_{n-1}$.

Coupling of the individual resonators of the resonator chambers $6_1, 6_2, \ldots, 6_n$ takes place in parallel or predominantly in parallel to the signal transmission direction 21. The H field 20 propagates at a right angle to or with one component primarily at a right angle to the signal transmission direction 21.

All the resonators $6_1, 6_2, \ldots, 6_n$ have the central axis 12 passing through them. The central axis 12 strikes the front face of the respective dielectrics $8_1, 8_2, \ldots, 8_n$ predominantly at a right angle to the signal propagation direction.

Figure 2:
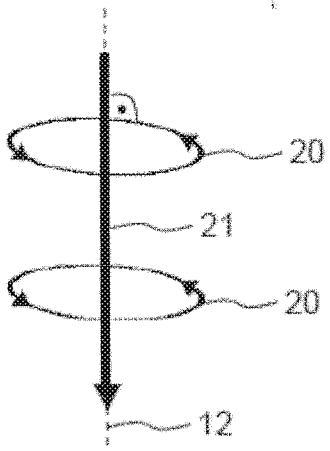
FIG. 2 a diagram illustrating a magnetic field arranged at a right angle to the signal transmission direction.

The inside wall of the housing 5 of the high-frequency filter 1 preferably has a cylindrical cross section. The same is also true of the inside wall of the respective insert $11_1, 11_2, \ldots, 11_n$. However, other shapes in the cross section are also possible. For example, the inside walls, as seen from above, may correspond in cross section to the shape of a rectangle or a square or an oval or a regular or irregular n-polygon or may approximate this shape. FIG. 2 shows a diagram illustrating a magnetic field 20 (H field) disposed at a right angle to the signal transmission direction 21. The magnetic field lines propagate radially outward around the signal transmission direction 21. The central axis 12 and the signal transmission direction 21 preferably coincide.

Figure 3:
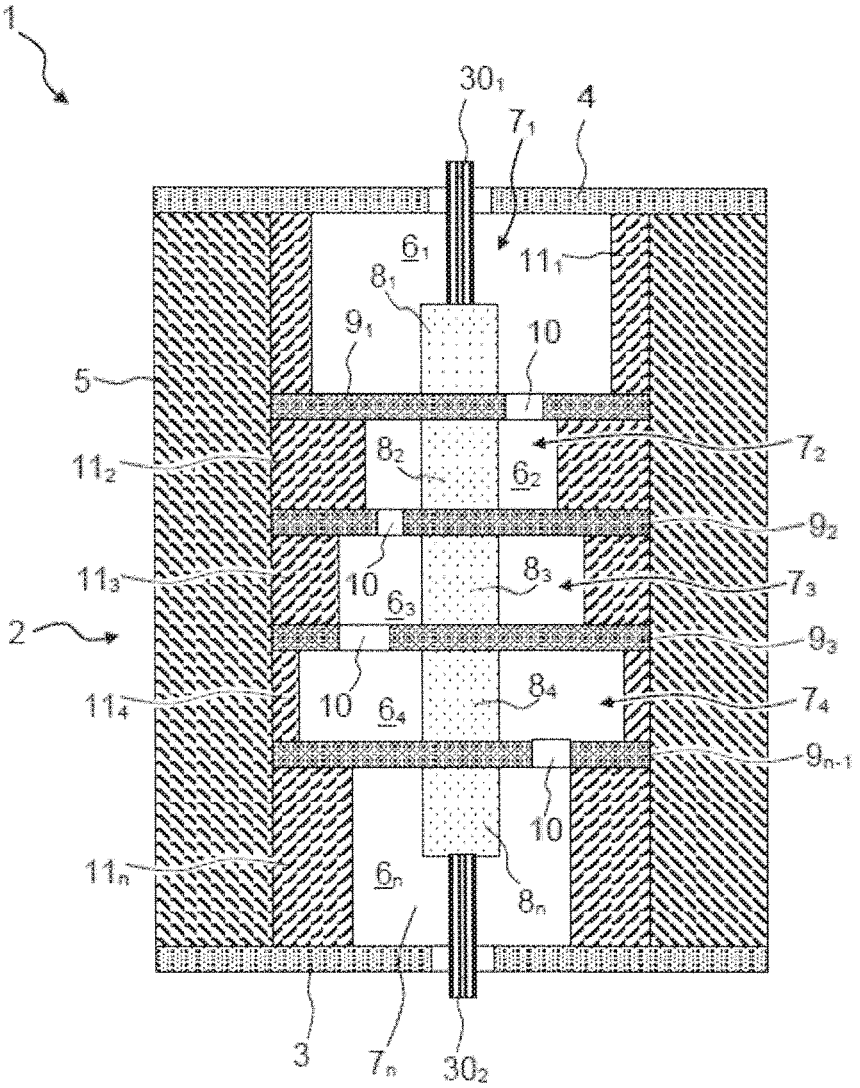
FIG. 3 a longitudinal section through the high-frequency filter, having a plurality of resonators with the respective resonator chambers, which are connected to one another through coupling openings in isolation devices.

FIG. 3 shows a longitudinal section through the high-frequency filter 1, having a plurality of resonators $6_1, 6_2, \ldots, 6_n$ with the respective resonator chambers $7_1, 7_2, \ldots, 7_n$, which are connected to one another through coupling openings 10 in the isolation devices $9_1, 9_2, \ldots, 9_{n-1}$. A first signal line terminal $30_1$ is passed through an opening in the housing bottom 3. The openings in the housing cover 4 and in the housing bottom 3 are preferably arranged centrally. The first signal line terminal $30_1$ contacts an end face of the first dielectric $8_1$. Therefore, the first dielectric $8_1$ is energized directly by the first signal line terminal $30_1$. The first signal line terminal $30_1$ is therefore in contact with the first dielectric $8_1$. The end face of the first dielectric $8_1$ in this exemplary embodiment is not in contact with the housing cover 4, which means that the end face $8_1$ does not touch the housing cover. The second signal line terminal $30_2$ also touches an end face of the $n^{th}$ dielectric $8_n$ and is in contact with it. Therefore, the $n^{th}$ dielectric $8_n$ is directly energized by the second signal line terminal $30_2$. The end face of the $n^{th}$ dielectric does not touch the housing bottom 3, i.e., it is not in contact with it. The high-frequency filter 1 from FIG. 3 has five resonators $6_1, 6_2, 6_3, 6_4, \ldots, 6_n$, each having one resonator chamber $7_1, 7_2, 7_3, 7_4, \ldots, 7_n$. Each resonator $6_1, 6_2, 6_3, 6_4, \ldots, 6_n$ comprises one dielectric $8_1, 8_2, 8_3, 8_4, \ldots, 8_n$.

The signal line terminals $30_1$ and $30_2$ are so located on different sides of housing 2, in particular on opposite sides. In particular, the first signal line terminal $30_1$ passes through the housing cover 4 and the second signal line terminal $30_2$ passes through the housing bottom 3 or vice versa.

The dielectrics $8_1, 8_2, 8_3, 8_4, \ldots, 8_n$ may all be made of the same material. It is also possible for only a few of the dielectrics $8_1, 8_2, 8_3, 8_4, \ldots, 8_n$ to be made of the same material and other dielectrics $8_1, 8_2, 8_3, 8_4, \ldots, 8_n$ to be made of another material. All the dielectrics $8_1, 8_2, 8_3, 8_4, \ldots, 8_n$ may be made of different materials.

In the exemplary embodiment from FIG. 3, the individual dielectrics $8_1, 8_2, \ldots, 8_n$ do not completely fill up the volume of the respective resonator chamber $7_1, 7_2, \ldots, 7_n$. In this exemplary embodiment, the dielectrics $8_1, 8_2, \ldots, 8_n$ have the same dimensions with respect to their respective height and their respective diameter. The inserts $11_1, 11_2, 11_3, 11_4, \ldots, 11_n$ all have the same outside diameter. However, their wall thickness, i.e., the inside diameter, is different. This means that the volume of the individual resonator chambers $7_1, 7_2, \ldots, 7_n$ is different. The outside surfaces of the inserts $11_1, 11_2, \ldots, 11_n$, i.e., the peripheral wall, are in contact with an inside surface of the housing wall 5. The electrically conductive housing cover 4 is in electrical contact with an end face of the housing 5 as well as with an end face of the first insert $\mathbf{11}_1$. The housing bottom 3 is also in electrical contact with the housing 5 and with an end face of the $n^{th}$ insert $\mathbf{11}_n$.

It should be pointed out here that the housing 5 may be electrically conductive, i.e., it may be made of metal, but that is not necessarily the case. In other words, the housing 5 may be made of any other material, in particular an electrically non-conductive material such as a dielectric or plastic. The function of the housing 5 is to mechanically hold together the components in the interior of the housing 5 and secure them mechanically. However, the housing 5 may then consist only of a dielectric if it is certain that the resonator chambers $\mathbf{7}_1, \mathbf{7}_2, \ldots, \mathbf{7}_n$ are shielded with respect to the environment of the high-frequency filter 1. Such a shielding may be accomplished through the inserts $\mathbf{11}_1, \mathbf{11}_2, \ldots, \mathbf{11}_n$, for example.

The isolation devices $\mathbf{9}_1, \mathbf{9}_2, \ldots, \mathbf{9}_{n-1}$ each have an outside diameter, which preferably corresponds to the inside diameter of the housing wall 5. This means that an outside surface, i.e., a peripheral wall of each isolation device $\mathbf{9}_1, \mathbf{9}_2, \ldots, \mathbf{9}_{n-1}$, touches the inside surface of the housing 5, i.e., is in mechanical contact with it. The coupling openings 10 of an isolation device $\mathbf{9}_1, \mathbf{9}_2, \ldots, \mathbf{9}_{n-1}$ may be different from the coupling openings of the other isolation devices $\mathbf{9}_1, \mathbf{9}_2, \ldots, \mathbf{9}_{n-1}$ with respect to their arrangement, i.e., their orientation and/or number and/or size and/or cross-sectional shape. Within the exemplary embodiment from FIG. 3, the coupling openings 10 of the individual isolation devices $\mathbf{9}_1, \mathbf{9}_2, \ldots, \mathbf{9}_{n-1}$ have a different diameter and are arranged in different locations in the isolation devices $\mathbf{9}_1, \mathbf{9}_2, \ldots, \mathbf{9}_{n-1}$, for example. The coupling openings 10 connect the individual resonator chambers $\mathbf{7}_1, \mathbf{7}_2, \ldots, \mathbf{7}_n$ to one another, wherein they are surrounded, on the one hand, by the free volume of a resonator $\mathbf{6}_1, \mathbf{6}_2, \ldots, \mathbf{6}_n$ or by the dielectric $\mathbf{8}_1, \mathbf{8}_2, \ldots, \mathbf{8}_n$ of the resonator $\mathbf{6}_1, \mathbf{6}_2, \ldots, \mathbf{6}_n$. An electrically conductive insert $\mathbf{11}_1, \mathbf{11}_2, \ldots, \mathbf{11}_n$ cannot cover a coupling opening 10. It is also possible for the cross section or shape of the individual coupling openings 10 to vary over the length, i.e., over the height. There is usually no cavity between the individual isolation devices $\mathbf{9}_1, \mathbf{9}_2, \ldots, \mathbf{9}_{n-1}$ and the inserts $\mathbf{11}_1, \mathbf{11}_2, \ldots, \mathbf{11}_n$. The same thing is preferably also true of the first insert $\mathbf{11}_1$ and the housing cover 4 as well as for $n_{th}$ insert $\mathbf{11}_1$ and the housing bottom 3.

There is usually also no distance between the inserts $\mathbf{11}_1, \mathbf{11}_2, \ldots, \mathbf{11}_n$ as well as the isolation devices $\mathbf{9}_1, \mathbf{9}_2, \ldots, \mathbf{9}_{n-1}$ and the housing wall 5.

The dielectrics $\mathbf{8}_1, \mathbf{8}_2, \ldots, \mathbf{8}_n$ are also in contact with their respective isolation device $\mathbf{9}_1, \mathbf{9}_2, \ldots, \mathbf{9}_{n-1}$. The dielectrics $\mathbf{8}_1, \mathbf{8}_2, \ldots, \mathbf{8}_n$ may be pressed and/or soldered to the respective isolation devices $\mathbf{9}_1, \mathbf{9}_2, \ldots, \mathbf{9}_{n-1}$.

The inserts $\mathbf{11}_1, \mathbf{11}_2, \ldots, \mathbf{11}_n$ are preferably also pressed together and/or soldered to the corresponding isolation devices $\mathbf{9}_1, \mathbf{9}_2, \ldots, \mathbf{9}_{n-1}$ in a form-fitting manner. This prevents twisting of the individual elements relative to one another, so that the electrical properties of the high-frequency filter 1 do not change over a prolonged period of time.

Figure 4:
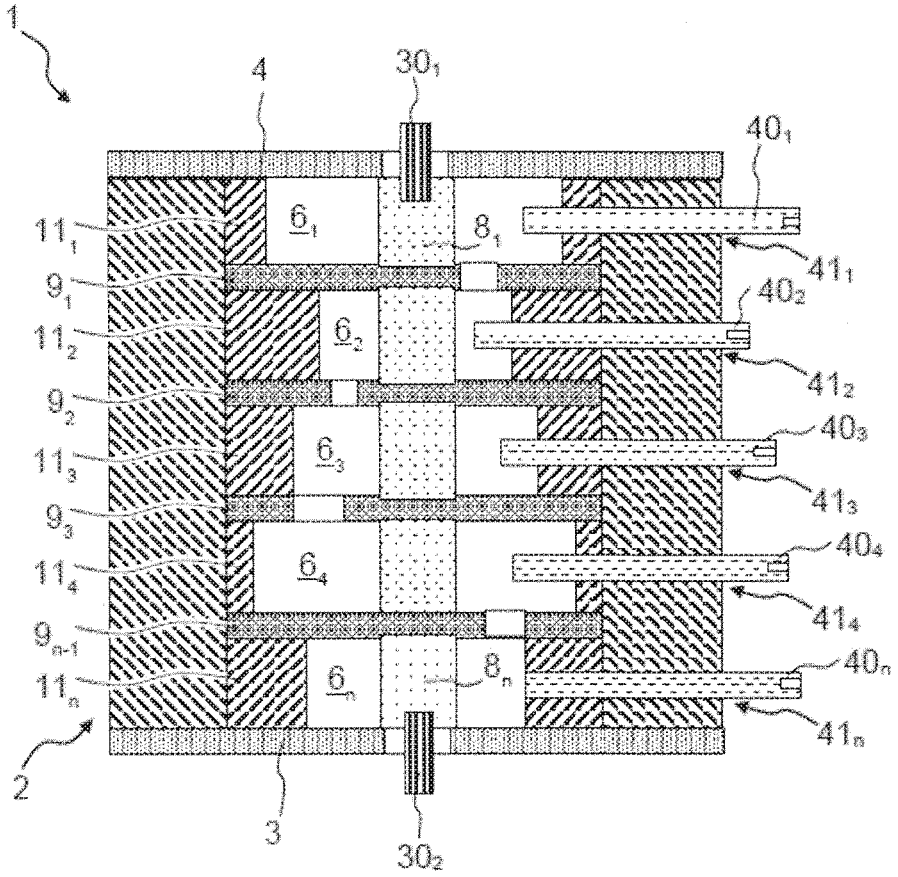
FIG. 4 a longitudinal section through another exemplary embodiment of the high-frequency filter, wherein tuning elements have been inserted to different extents into the individual resonator chambers.

FIG. 4 shows a longitudinal section through another exemplary embodiment of the high-frequency filter 1. The first dielectric $\mathbf{8}_1$ is in contact with the housing cover 4 on its front face. There is no distance between the first dielectric $\mathbf{8}_1$ and the housing cover 4. The same thing is also true of the $n^{th}$ dielectric $\mathbf{8}_n$, which is also in contact at its front face with the housing bottom 3. There is again no distance between the $n^{th}$ dielectric $\mathbf{8}_n$ and the housing bottom 3. The elements of the high-frequency filter 1 are preferably pressed to one another; for example, this pressing is manifested in the fact that the individual dielectrics $\mathbf{8}_1, \mathbf{8}_2, \ldots, \mathbf{8}_n$ partially protrude into the individual isolation devices $\mathbf{9}_1, \mathbf{9}_2, \ldots, \mathbf{9}_{n-1}$.

The high-frequency filter 1 also has a plurality of tuning elements $\mathbf{40}_1, \mathbf{40}_2, \mathbf{40}_3, \mathbf{40}_4, \ldots, \mathbf{40}_n$. At least one tuning element $\mathbf{40}_1, \mathbf{40}_2, \ldots, \mathbf{40}_n$ is inserted through an additional opening $\mathbf{41}_1, \mathbf{41}_2, \mathbf{41}_3, \mathbf{41}_4, \ldots, \mathbf{41}_n$ into the resonator chamber $\mathbf{7}_1, \mathbf{7}_2, \ldots, \mathbf{7}_n$ of the at least one of the n resonators $\mathbf{6}_1, \mathbf{6}_2, \ldots, \mathbf{6}_n$. The openings $\mathbf{41}_1, \mathbf{41}_2 \ldots, \mathbf{41}_n$ extend through the housing wall 5 and through the corresponding insert $\mathbf{11}_1, \mathbf{11}_2, \ldots, \mathbf{11}_n$ into the resonator chamber $\mathbf{7}_1, \mathbf{7}_2, \ldots, \mathbf{7}_n$. The corresponding tuning element $\mathbf{40}_1, \mathbf{40}_2, \ldots, \mathbf{40}_n$ can then be screwed into or out of the respective resonator chamber $\mathbf{7}_1, \mathbf{7}_2, \ldots, \mathbf{7}_n$. The distance between the tuning element $\mathbf{41}_1, \mathbf{41}_2 \ldots, \mathbf{41}_n$ and the respective dielectric $\mathbf{8}_1, \mathbf{8}_2, \ldots, \mathbf{8}_n$ is variable. The respective opening $\mathbf{41}_1, \mathbf{41}_2 \ldots, \mathbf{41}_n$ preferably runs at a right angle to the signal propagation direction 21 and thus also perpendicular to the central axis 12.

The distance of the at least one tuning element $\mathbf{40}_1, \mathbf{40}_2, \ldots, \mathbf{40}_n$ to the respective dielectric $\mathbf{8}_1, \mathbf{8}_2, \ldots, \mathbf{8}_n$ in the resonator chamber $\mathbf{7}_1, \mathbf{7}_2, \ldots, \mathbf{7}_n$ can be reduced to such an extent that it is in contact with the dielectric $\mathbf{8}_1, \mathbf{8}_2, \ldots, \mathbf{8}_n$, i.e., it touches it.

The first dielectric $\mathbf{8}_1$ in the first resonator $\mathbf{6}_1$ has an indentation into which the first signal line $\mathbf{30}_1$ protrudes. Therefore, the coupling is strengthened. The first signal line $\mathbf{30}_1$ is preferably in contact with the dielectric $\mathbf{8}_1$. However, it would also be possible for the first signal line $\mathbf{30}_1$ to be arranged in the first dielectric $\mathbf{8}_1$ without coming in contact with it. The same thing is also true of the $n^{th}$ dielectric $\mathbf{8}_n$ in the $n^{th}$ resonator $\mathbf{6}_n$. The indentation may be placed centrally or eccentrically on the dielectric $\mathbf{8}_1, \mathbf{8}_n$.

Figure 5:
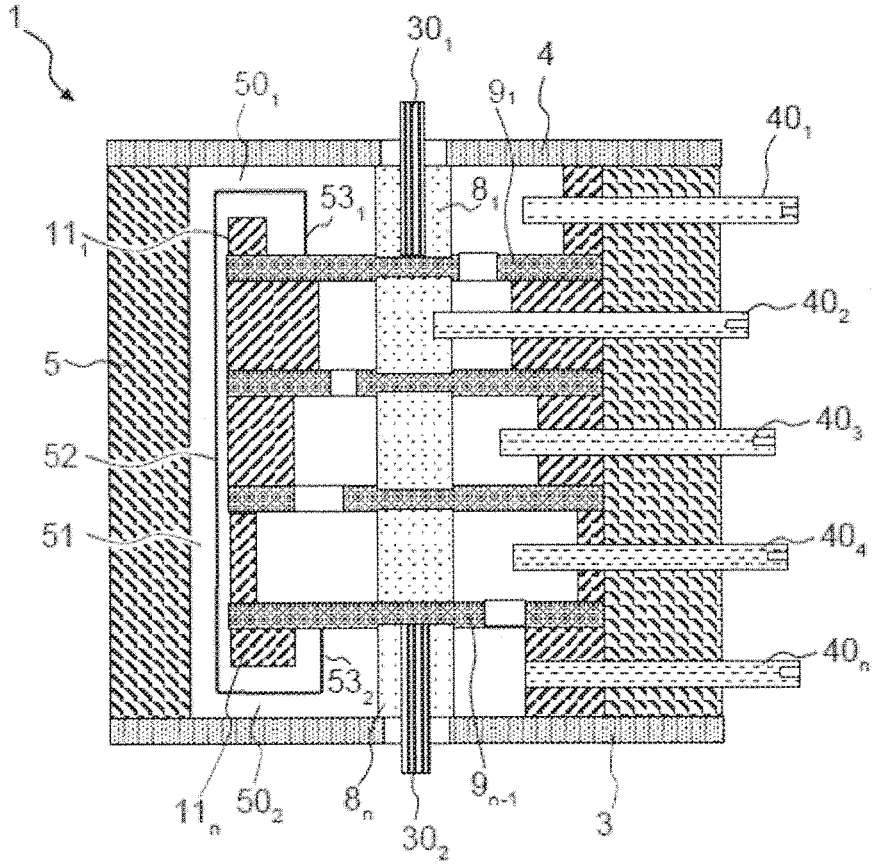
FIG. 5 a longitudinal section through another exemplary embodiment of the high-frequency filter, wherein there is cross-coupling between two different resonator chambers not situated next to one another, and the tuning element can be inserted into the dielectric.

FIG. 5 shows a longitudinal section through another exemplary embodiment of the high-frequency filter 1.

The dielectric $\mathbf{8}_1$ in the first resonator chamber $\mathbf{7}_1$ has a continuous recess through which the first signal line $\mathbf{30}_1$ passes. The first signal line $\mathbf{30}_1$ comes directly in contact with the first isolation device $\mathbf{9}_1$. The same thing is also true of the second signal line terminal $\mathbf{30}_2$, which extends through a continuous recess in the $n^{th}$ dielectric $\mathbf{8}_n$ of the $n^{th}$ resonator $\mathbf{6}_n$ and is in contact with the $n-1^{th}$ isolation device $\mathbf{9}_{n-1}$. The respective signal line terminals $\mathbf{30}_1, \mathbf{30}_2$ are preferably also in contact with the respective dielectric $\mathbf{8}_1, \mathbf{8}_n$, through which they pass. However, they may also be arranged without contacting it. The continuous recess may also be created centrally or eccentrically on the dielectric $\mathbf{8}_1, \mathbf{8}_n$.

The portion of the signal line terminal $\mathbf{30}_1, \mathbf{30}_2$, which is in contact with the respective dielectric $\mathbf{8}_1, \mathbf{8}_n$ or with the respective isolation device $\mathbf{9}_1, \mathbf{9}_{n-1}$, runs parallel to the central axis 12 and/or parallel to the signal transmission direction 21. The other parts of the signal line terminal $\mathbf{30}_1, \mathbf{30}_2$ need not run parallel to the signal transmission direction 21 and/or to the central axis 12. The parts of the two signal line terminals $\mathbf{30}_1, \mathbf{30}_2$ running parallel to the signal transmission direction 21 are preferably situated inside the first or $n^{th}$ resonator chambers $\mathbf{7}_1, \mathbf{7}_n$.

The second dielectric $\mathbf{8}_2$ in the second resonator chamber $\mathbf{7}_2$ also has an indentation, so that a second tuning element $\mathbf{40}_1$ can be inserted into the second dielectric $\mathbf{8}_2$.

The inserts $\mathbf{11}_1, \mathbf{11}_2, \ldots, \mathbf{11}_n$ of at least two resonators $\mathbf{6}_1, \mathbf{6}_2, \ldots, \mathbf{6}_n$, which are not directly adjacent to one another, each have an opening $\mathbf{50}_1, \mathbf{50}_2$. The at least two openings $50_1$, $50_2$ are connected to one another by a duct 51, so that this duct 51 preferably runs parallel to the signal propagation direction 21, i.e., parallel to the central axis 12. This duct 51 runs at least partially inside the housing wall 5. It is also possible for this duct to run completely inside the housing wall 5. It is also possible for this duct not to run within the housing wall 5 but instead to run only through the inserts $11_1$, $11_2$, . . . , $11_n$ and the isolation devices $9_1$, $9_2$, . . . , $9_{n-1}$ that are situated in between.

An electric conductor 52 runs inside this duct 51. This electric conductor 52 couples the at least two resonators $6_1$, $6_n$ capacitively and/or inductively to one another. A first end $53_1$ of the electric conductor 52 is connected to the first isolation device $9_1$. The first end $53_1$ of the electric conductor 52 preferably runs parallel to the signal propagation direction 21 and thus parallel to the central axis 12. A second end $53_2$ of the electric conductor 52 is galvanically connected to the n−1$^{th}$ isolation device $9_{n-1}$. The second end $53_2$ also preferably runs parallel to the signal propagation direction 21 and therefore parallel to the central axis 12. The first and the second end $53_1$, $53_2$ may be connected to the respective isolation devices $9_1$, $9_2$, . . . , $9_{n-1}$ by means of a soldered connection, for example. Due to this electrical conductor 52, a cross-coupling is achieved between two resonators $6_1$, $6_2$, . . . , $6_n$, so that a steeper filter edge of the high-frequency filter 1 can be achieved.

The electric conductor 52 running inside the duct 51 is electrically isolated from the walls enclosing the duct 51, preferably by means of dielectric spacer elements (not shown) inside the duct and is held in its position by them.

Figure 6:
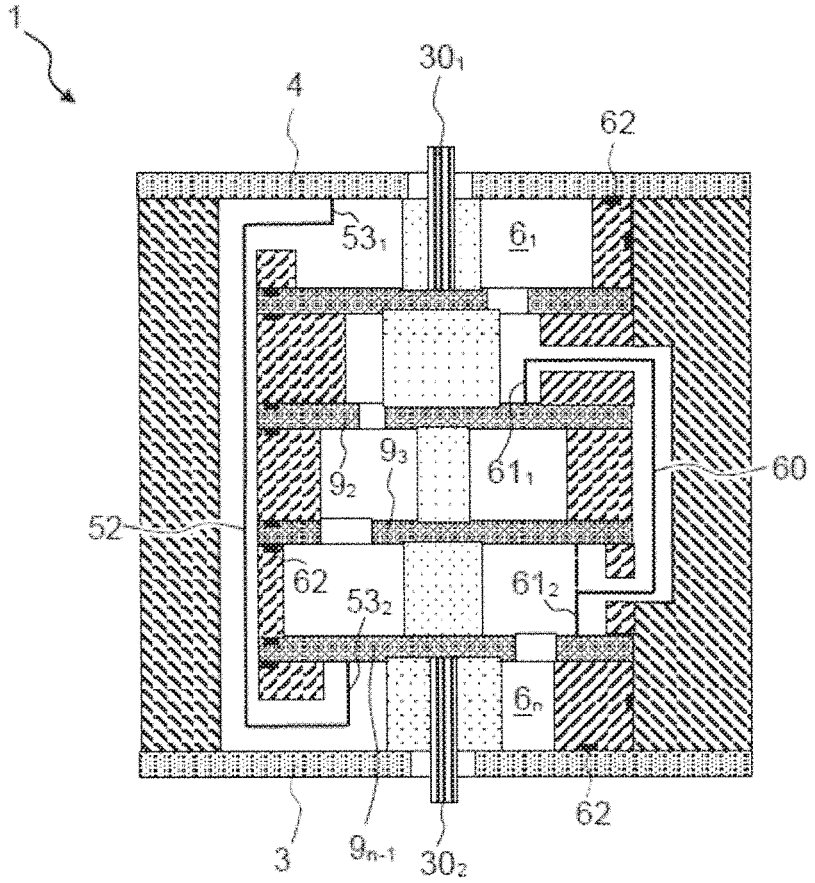
FIG. 6 a longitudinal section through another exemplary embodiment of the high-frequency filter, wherein there are multiple cases of cross-coupling between two different resonator chambers not situated next to one another.

FIG. 6 shows a longitudinal section through another exemplary embodiment of the high-frequency filter 1. In this exemplary embodiment, there are two cross-couplings. The first cross-coupling is between the first resonator $6_1$ and the n$^{th}$ resonator $6_n$. An electric conductor 52 couples these two resonators $6_1$, $6_n$ to one another. In this case, a first end $53_1$ of the electric conductor 52 is connected to the housing cover 4.

A second cross-coupling occurs between the second resonator $6_2$ and the fourth resonator $6_4$. An electric conductor 60 couples these two resonators $6_2$, $6_4$ to one another. A first end $61_1$ of the second electric conductor 60 is connected to the second isolation device $9_2$. A second end $61_2$ of the electric conductor is connected to the n−1th isolation device $9_{n-1}$. One possibility for also connecting the 25 second end $61_2$ of the second electric conductor 60 to the third isolation device $9_3$ is indicated with dashed lines.

In order for the filter properties not to change during operation, the elements arranged inside the high-frequency filter 1 are secured to prevent twisting. This is accomplished by means of a plurality of twist preventing elements 62, which prevent twisting. The twist preventing elements 62 may consist of a combination of a protrusion and a receiving opening. For example, the housing cover 4 may have a protrusion, which engages in a corresponding receiving opening inside the first insert $11_1$. The twist preventing elements 62 are preferably mounted between at least one of the n−1 isolation devices $9_1$, $9_2$, . . . , $9_n$ and the at least one insert $11_1$, $11_2$, . . . , $11_n$ and/or the adjacent dielectric $8_1$, $8_2$, . . . , $8_n$. However, preferably one twist preventing element 62 is arranged between the housing bottom 3 and/or the housing cover 4 and/or the housing wall 5 and the insert $11_1$ in the first resonator chamber $7_1$ and the insert $11_n$ in the n$^{th}$ resonator chamber $7_n$, which prevents mutual twisting of the elements, which are arranged next to the first and/or second signal line terminals $30_1$, $30_2$. This also prevents twisting of the elements, which are arranged farther toward the inside in the high-frequency filter 1.

The high-frequency filter 1 is preferably implemented in a stack-type design, wherein all the resonators $6_1$, $6_2$, . . . , $6_n$ are arranged one above the other. The twist preventing elements 62 prevent the electric properties of the individual resonators $6_1$, $6_2$, . . . , $6_n$ from changing to those belonging to the resonant frequencies, for example.

Figure 7:
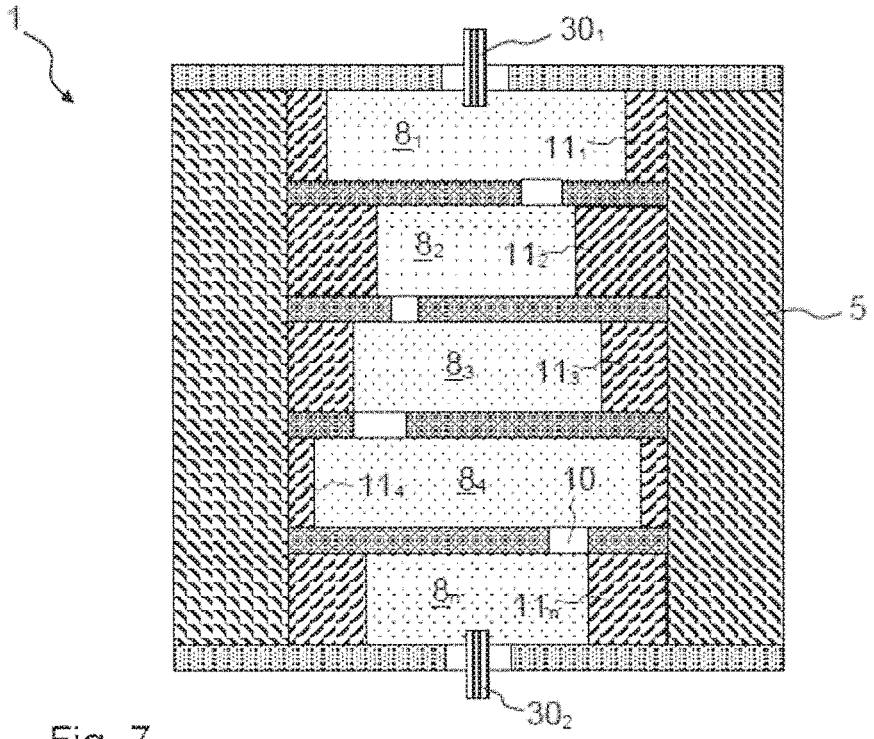
FIG. 7 a longitudinal section through another exemplary embodiment of the high-frequency filter, wherein the resonator chambers are completely filled up by the respective dielectric.

FIG. 7 shows a longitudinal section through an additional exemplary embodiment of the high-frequency filter 1. The individual resonator chambers $7_1$, $7_2$, . . . , $7_n$ are filled completely by the respective dielectric $8_1$, $8_2$, . . . , $8_n$. The height of each dielectric $8_1$, $8_2$, . . . , $8_n$ corresponds to the height of the respective insert $11_1$, $11_2$, . . . , $11_n$. The outside diameter of each dielectric $8_1$, $8_2$, . . . , $8_n$ corresponds approximately to the inside diameter of the respective insert $11_1$, $11_2$, . . . , $11_n$. The dielectric $8_1$, $8_2$, . . . , $8_n$ is in form-fitting contact with its peripheral wall on an inside wall of the respective insert $11_1$, $11_2$, . . . , $11_n$.

Figure 8:
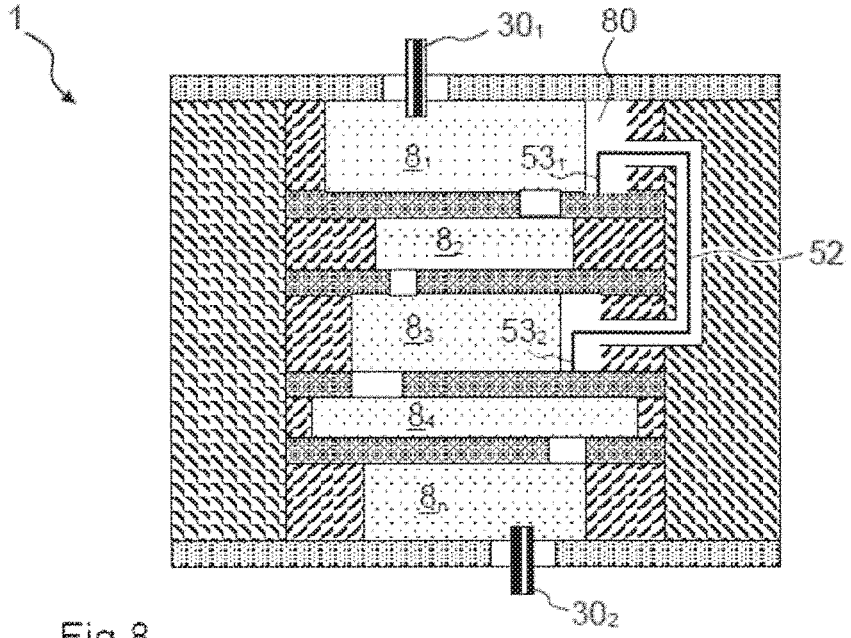
FIG. 8 a longitudinal section through another exemplary embodiment of the high-frequency filter, wherein the resonator chambers are completely filled up by the respective dielectric and wherein a first and a second signal line terminal are each in contact eccentrically with a dielectric.

FIG. 8 shows a longitudinal section through another exemplary embodiment of the high-frequency filter 1. The first signal line terminal $30_1$ contacts the first dielectric $8_1$ eccentrically. The same is also true of the second signal line terminal $30_2$, which contacts the n$^{th}$ dielectric eccentrically. Cross-coupling can also be achieved between two resonators $6_1$, $6_2$, . . . , $6_n$ that are not directly adjacent to one another despite the fact that the dielectric $8_1$, $8_2$, . . . , $8_n$ completely fills up the volume of its respective resonator chamber $7_1$, $7_2$, . . . , $7_n$. There is cross-coupling between the first resonator $6_1$ and the third resonator $6_3$ in the exemplary embodiment from FIG. 8. The first dielectric $8_1$ and the third dielectric $8_3$, i.e., the dielectrics $8_1$, $8_2$, . . . , $8_n$ between whose resonators $6_1$, $6_2$, . . . , $6_n$ the cross-coupling should take place, have a slot 80, preferably continuous, in the longitudinal direction. This continuous slot 80 can be created in the dielectric $8_1$, $8_2$, . . . , $8_n$, which is made of a ceramic, by using a diamond saw, for example. At least the first end $53_1$ and the second end $53_2$ of the electric conductor 52 are arranged inside this slot 80.

Figure 9A:
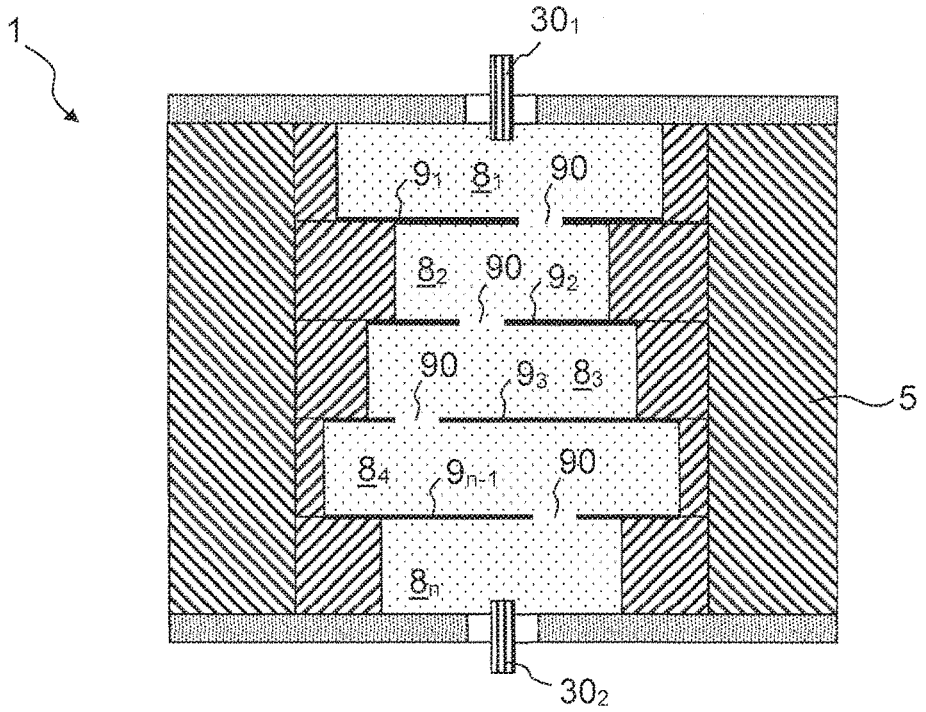
FIG. 9A a longitudinal section through another exemplary embodiment of the high-frequency filter, wherein the dielectrics have an electrically conductive coating on at least their front end and they function as an isolation device.

FIG. 9A shows a longitudinal section though another exemplary embodiment of the high-frequency filter 1. The isolation device $9_1$, $9_2$, . . . , $9_{n-1}$ is an integral component of each dielectric $8_1$, $8_2$, . . . , $8_n$. This means that one or both end faces of the n dielectrics $8_1$, $8_2$, . . . , $8_n$ are coated with a metal layer. This metal layer then forms one of the n−1$^{th}$ isolation devices $9_1$, $9_2$, . . . , $9_{n-1}$. A recess 90 in the metal layer, i.e., inside the coating, forms a coupling opening 10 between two resonators $6_1$, $6_2$, . . . , $6_n$. Adjacent dielectrics $8_1$, $8_2$, . . . , $8_n$ have the recesses 90 inside the coating of the metal layer at the same locations, so that a coupling in the signal propagation direction 21 is made possible.

Figure 9B:
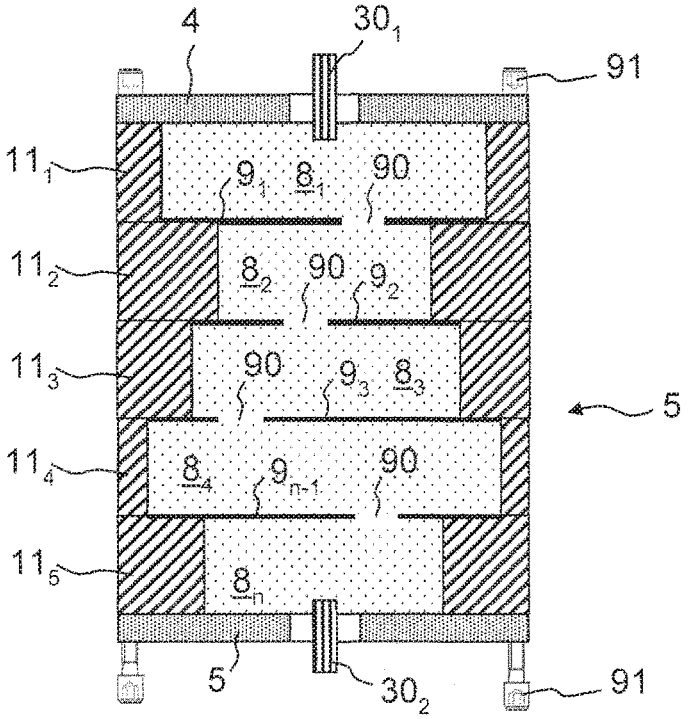
FIG. 9B a longitudinal section through another exemplary embodiment of the high-frequency filter, wherein the inserts together with a housing cover and the housing bottom form the housing.

FIG. 9B shows a modified embodiment from FIG. 9A. In contrast with FIG. 9A, the inserts $11_1$, $11_2$, . . . , $11_n$ form the housing wall 5. The housing 2 is formed in this case from the inserts $11_1$, $11_2$, . . . , $11_n$, the housing bottom 3 and the housing cover 4. The inserts $11_1$, $11_2$, . . . , $11_n$ are preferably joined to one another by screws 91, which preferably also extend in parallel with the central axis 12. Supplementary or alternative joining is also possible by means of an adhesive or by means of a soldered and/or welded joint. The inserts $11_1$, $11_2$, . . . , $11_n$ could at any rate be joined to one another without tools by means of a snap connection. In this case, a protrusion on the surface of an insert $11_1$, $11_2$, . . . , $11_n$, which (the surface) runs parallel to the housing cover 4 or the housing bottom 3, may be inserted into an opening in the neighboring insert $11_1$, $11_2$, . . . , $11_n$, wherein the protrusion is in the opening by a rotational movement, such that the inserts $\mathbf{11}_1$, $\mathbf{11}_2$, . . . , $\mathbf{11}_n$ can no longer become loosened from one another merely when a force is applied along the central axis 12.

For the case when the isolation devices $\mathbf{9}_1$, $\mathbf{9}_2$, $\mathbf{9}$ . . . , $\mathbf{9}_{n-1}$ are not designed in the form of a coating on the dielectrics $\mathbf{8}_1$, $\mathbf{8}_2$, . . . , $\mathbf{8}_n$, they would be arranged between the inserts $\mathbf{11}_1$, $\mathbf{11}_2$, . . . , $\mathbf{11}_n$. they could then be either a part of the outside wall of the housing wall 5 or could be arranged in a recess in the inserts $\mathbf{11}_1$, $\mathbf{11}_2$, . . . , $\mathbf{11}_n$, in the area of which the inserts $\mathbf{11}_1$, $\mathbf{11}_2$, . . . , $\mathbf{11}_n$ have a reduced thickness. In this case, the isolation devices $\mathbf{9}_1$, $\mathbf{9}_2$, . . . , $\mathbf{9}_{n-1}$ would not be visible from the outside.

Figure 10:
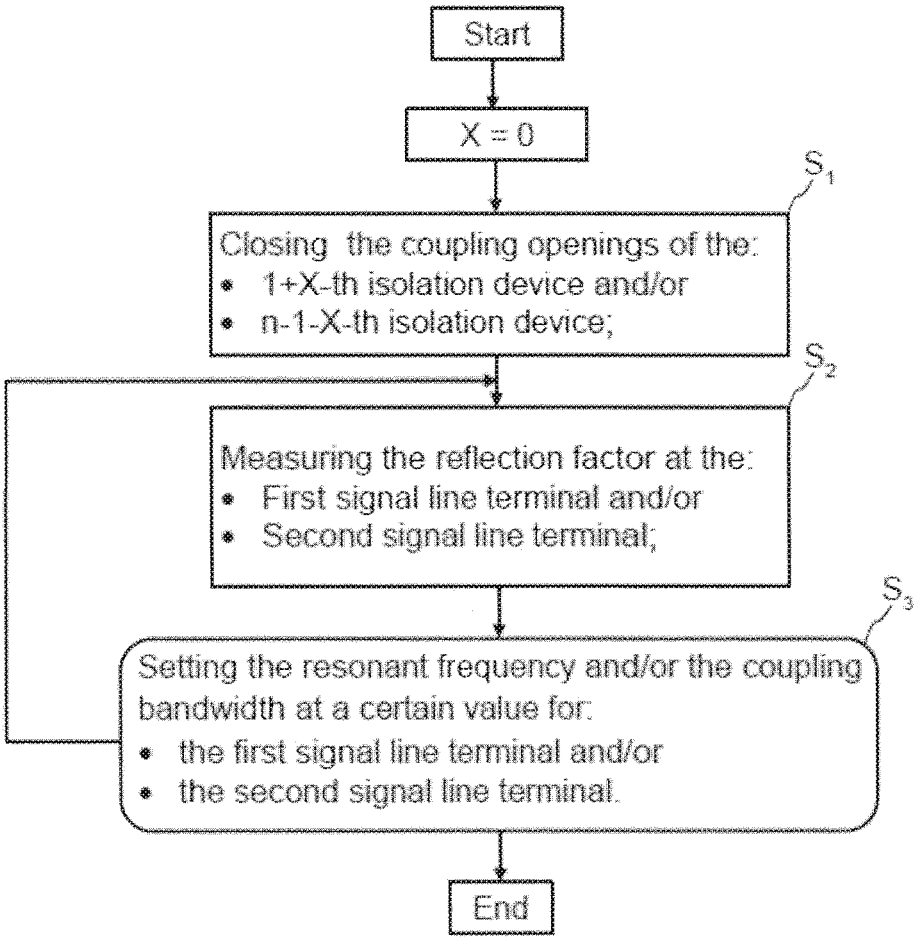
FIG. 10 a flow chart, which illustrates the resonant frequency and/or the coupling bandwidth of a resonator being set in order to adjust the high-frequency filter.

FIG. 10 shows a flow chart, which illustrates how the resonant frequency and/or the coupling bandwidth is/are adjusted for a resonator $\mathbf{6}_1$, $\mathbf{6}_2$, . . . , $\mathbf{6}_n$ to adjust the high-frequency filter 1. A counter variable X is initially defined as 0. The process step $S_1$ is carried out next. All the coupling openings 10 of the $1+x^{th}$ isolation device and/or the n−1th isolation device are closed during process step $S_1$. With regard to the longitudinal section in FIG. 4, these will be the coupling openings 10 in the first isolation device $\mathbf{9}_1$ and in the last isolation device $\mathbf{9}_{n-1}$.

The process step $S_2$ is carried out after that. During the process step $S_2$ the reflection factor at the first signal line terminal $\mathbf{30}_1$ and/or at the second signal line terminal $\mathbf{30}_2$ is/are measured. The measured reflection factor is determined solely from the geometric properties of the first and the $n^{th}$ resonators $\mathbf{6}_1$, $\mathbf{6}_n$. Process step $S_3$ is carried out after that. During process step $S_3$, the resonant frequency and/or the coupling bandwidth of the first and/or $n^{th}$ resonators $\mathbf{6}_1$, $\mathbf{6}_n$ is/are set at a certain level. In alternation with that, the process step $S_2$ is again carried out in order to again measure the altered reflection factor, to thereby ascertain whether the process step $S_3$ must be carried out again or whether the values that have been set for the resonant frequency and/or the coupling bandwidth already correspond to the desired values.

The high-frequency filter 1 is adjusted from the outside to the inside, i.e., beginning at the resonators $\mathbf{6}_1$, $\mathbf{6}_n$, which are arranged at the first and/or second signal line terminals $\mathbf{30}_1$, $\mathbf{30}_2$. Then additional resonators $\mathbf{6}_2$, $\mathbf{6}_3$ . . . , $\mathbf{6}_{n-2}$ are gradually connected in succession by opening the respective coupling openings. This operation is illustrated in FIG. 11 and described in conjunction therewith.

Figure 11:
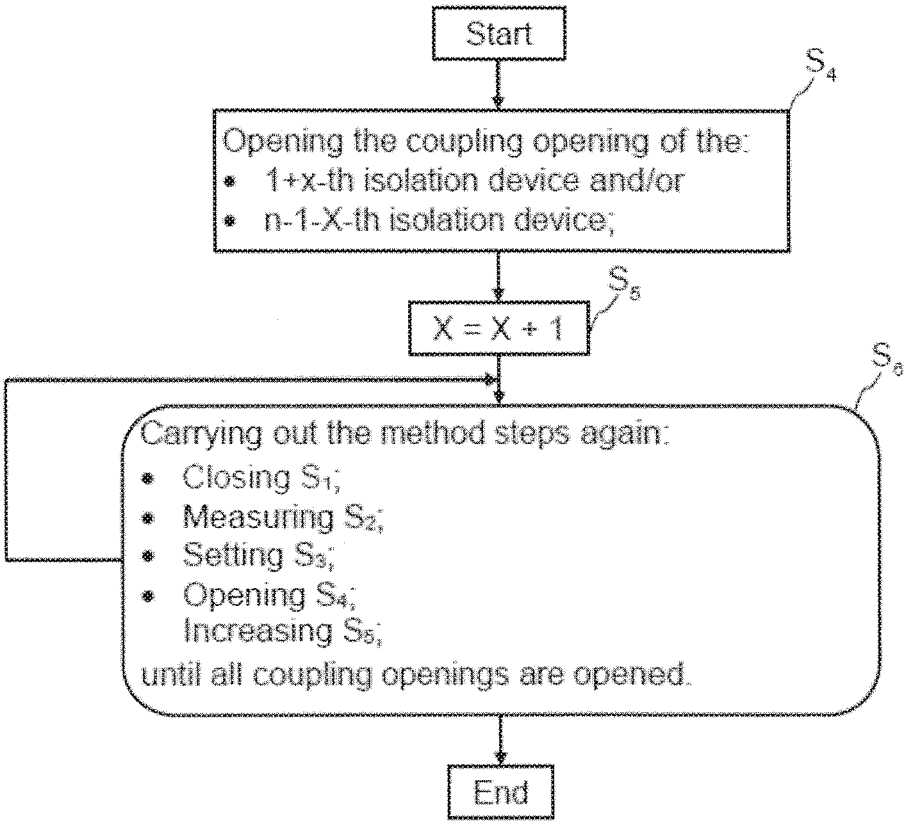
FIG. 11 another flow chart, which illustrates how the resonant frequencies and/or the coupling bandwidths for the additional resonators are set to adjust the high-frequency filter.

FIG. 11 shows another flow chart, which illustrates how the resonant frequencies and/or the coupling bandwidths are adjusted for the additional resonators $\mathbf{6}_2$, $\mathbf{6}_3$ . . . , $\mathbf{6}_{n-1}$ in order to adjust the high-frequency filter 1. In the case when the resonant frequencies and/or the coupling bandwidth for the first resonator $\mathbf{6}_1$ and/or for the $n^{th}$ resonator $\mathbf{6}_n$ have been set, the process step $S_4$ is carried out. During the process step $S_4$, at least one coupling opening 10 of the $1+X^{th}$ isolation device and/or the $n-1-X^{th}$ isolation device is/are opened. With respect to FIG. 4, this would be the coupling opening 10 in the isolation devices $\mathbf{9}_1$ and $\mathbf{9}_{n-1}$.

Process step $S_5$ is carried out after this. During the process step $S_5$, the value of X is incremented by 1. After that, process step $S_6$ is carried out, during which the process steps $S_1$, $S_2$, $S_3$, $S_4$, $S_5$ are carried out again, namely until all the coupling openings 10 have been opened. This means that, after this, with a view to FIG. 4, the coupling openings 10 of the isolation device $\mathbf{9}_2$ and the coupling openings 10 of the isolation device $\mathbf{9}_3$ are closed. The reflection factor on the first signal line terminal $\mathbf{30}_1$ and/or on the second signal line terminal $\mathbf{30}_2$ is measured again. After that, the resonant frequency and/or the coupling bandwidth of the first two resonators $\mathbf{6}_1$, $\mathbf{6}_2$ and the last two resonators $\mathbf{6}_n$, $\mathbf{6}_{n-1}$ is/are set again.

After that, the value for X is again incremented by 1, i.e., process step $S_5$ is carried out again.

With reference to FIG. 4, it can be seen that there is an odd number of resonators $\mathbf{6}_1$, $\mathbf{6}_2$, . . . , $\mathbf{6}_n$. The resonator $\mathbf{6}_3$, i.e., the resonator at the center of the high-frequency filter 1, is used once in the method for adjusting the high-frequency filter 1 for calculating the reflection factor on the first signal line terminal $\mathbf{30}_1$ and once for calculating the reflection factor on the second signal line terminal $\mathbf{30}_2$.

Figure 12:
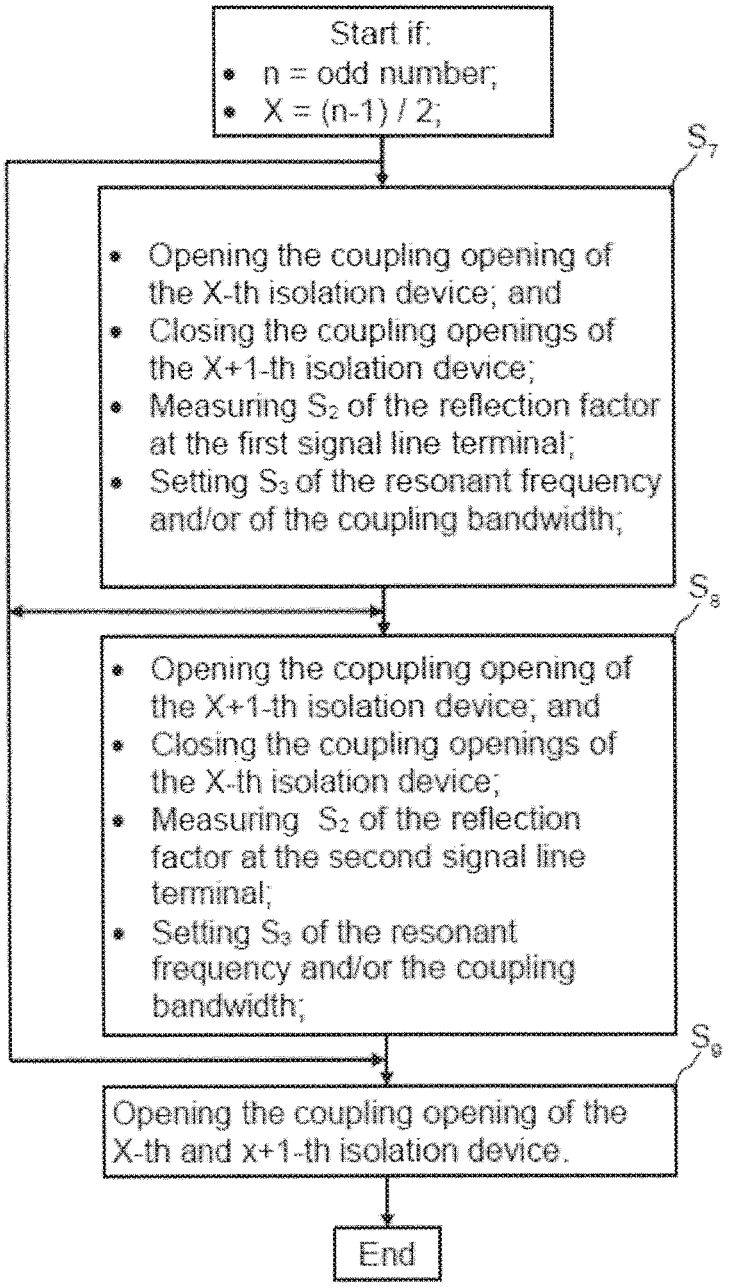
FIG. 12 another flow chart, which illustrates how the resonant frequency and/or the coupling bandwidth for the resonator is/are set at the center of the high-frequency filter.

This situation is repeated in the flow chart in FIG. 12 which illustrates how the resonant frequency and/or the coupling bandwidth for the resonator at the center of the high-frequency filter 1 is/are adjusted. The process steps $S_7$ and/or $S_8$ and $S_9$ are carried out in the case when X reaches the value (n−1)/2, which corresponds to the value "2" in the exemplary embodiment in FIG. 4.

In process step $S_7$, the coupling openings 10 of the $X^{th}$ isolation device are opened and the coupling openings 10 of the $X+1^{th}$ isolation device are closed. In the exemplary embodiment from FIG. 4, the coupling openings in the isolation device $\mathbf{9}_2$ would be opened and those in the isolation device $\mathbf{9}_3$ would be closed. After that, the reflection factor is measured on the first signal line terminal $\mathbf{30}_1$ and the resonant frequency and/or the coupling bandwidth is/are adjusted accordingly.

Instead of or as an alternative to that, the coupling opening 10 of the $X+1^{th}$ isolation device is opened in process step S and the coupling openings 10 of the $X^{th}$ isolation device are closed. In the exemplary embodiment in FIG. 4, the coupling openings 10 in the isolation device $\mathbf{9}_2$ would be closed in this case, whereas the coupling opening 10 inside the isolation device $\mathbf{9}_3$ would be opened. After that, the process step $S_2$ would be carried out again and the reflection factor on the second signal line terminal $\mathbf{30}_2$ would be measured. After that, the process step $S_3$ is carried out, during which the resonant frequency and/or the coupling bandwidth is/are adjusted.

The resonant frequency and/or the coupling bandwidth of the resonator at the center of the high-frequency filter 1 must be adjusted, so that an acceptable value is achieved for both the reflection factor on the first signal line terminal $\mathbf{30}_1$ as well as for the reflection factor on the second signal line terminal $\mathbf{30}_2$. In some cases, it must be necessary to make a compromise here.

The process step $S_9$ is carried out after that and the coupling openings of the $X^{th}$ and the $X+1^{th}$ isolation devices are opened. In this state, all the coupling openings 10 in all the isolation devices $\mathbf{9}_1$, $\mathbf{9}_2$, . . . , $\mathbf{9}_n$ are opened. This state occurs automatically after going through the flow chart in FIG. 11, when there is an even number of resonators $\mathbf{6}_1$, $\mathbf{6}_2$, . . . , $\mathbf{6}_n$.

Figure 13:
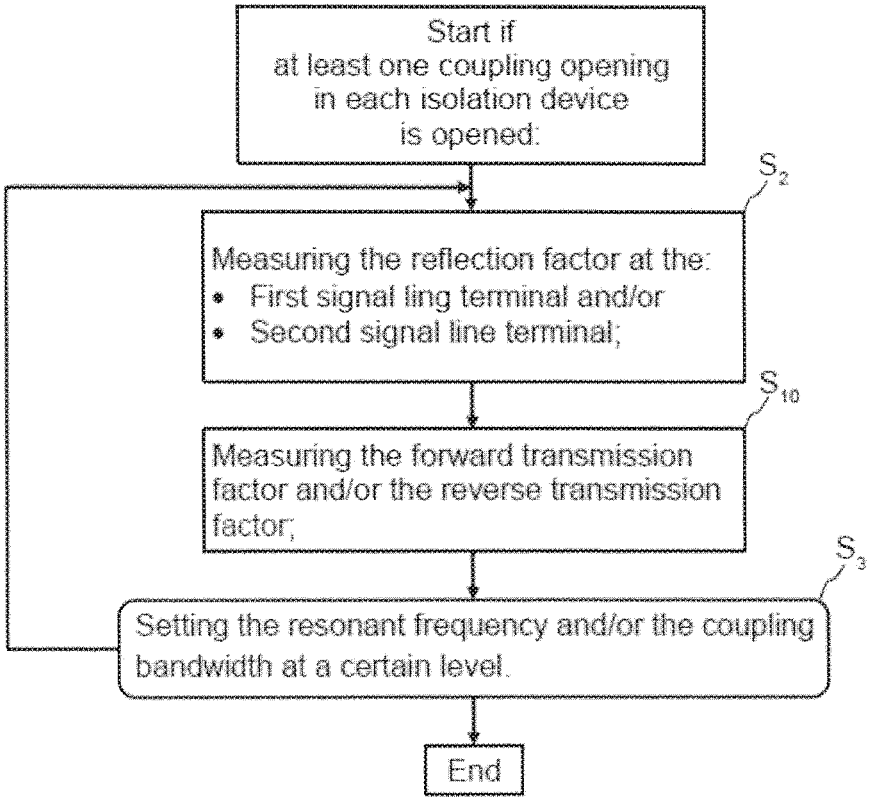
FIG. 13 another flow chart, which illustrates how the high-frequency filter is adjusted after at least one coupling opening has opened in each isolation device.

For the case when at least one coupling opening 10 is opened in each isolation device $\mathbf{9}_1$, $\mathbf{9}_2$, . . . , $\mathbf{9}_n$, the process steps $S_2$, $S_{10}$ and $S_3$ which are illustrated in the flow chart in FIG. 13, are carried out. The process step $S_2$ which has already been explained with reference to FIG. 10, is carried out here. During this process step, a reflection factor on the first signal line terminal $\mathbf{30}_1$ and/or on the second signal line terminal $\mathbf{30}_2$ is/are measured. The process step $S_{10}$ is carried out after that. During the process step $S_{10}$ the forward transmission factor and/or the reverse transmission factor is/are determined.

After that, the resonant frequency and/or the coupling bandwidth is/are again set at a specific value and/or is/are finally adjusted. This is done in the process step $S_3$. The process steps $S_2$ and $S_{10}$ are repeated until the desired target value for the resonant frequency and/or the coupling bandwidth has been reached, as in process step $S_3$.

Figure 14:
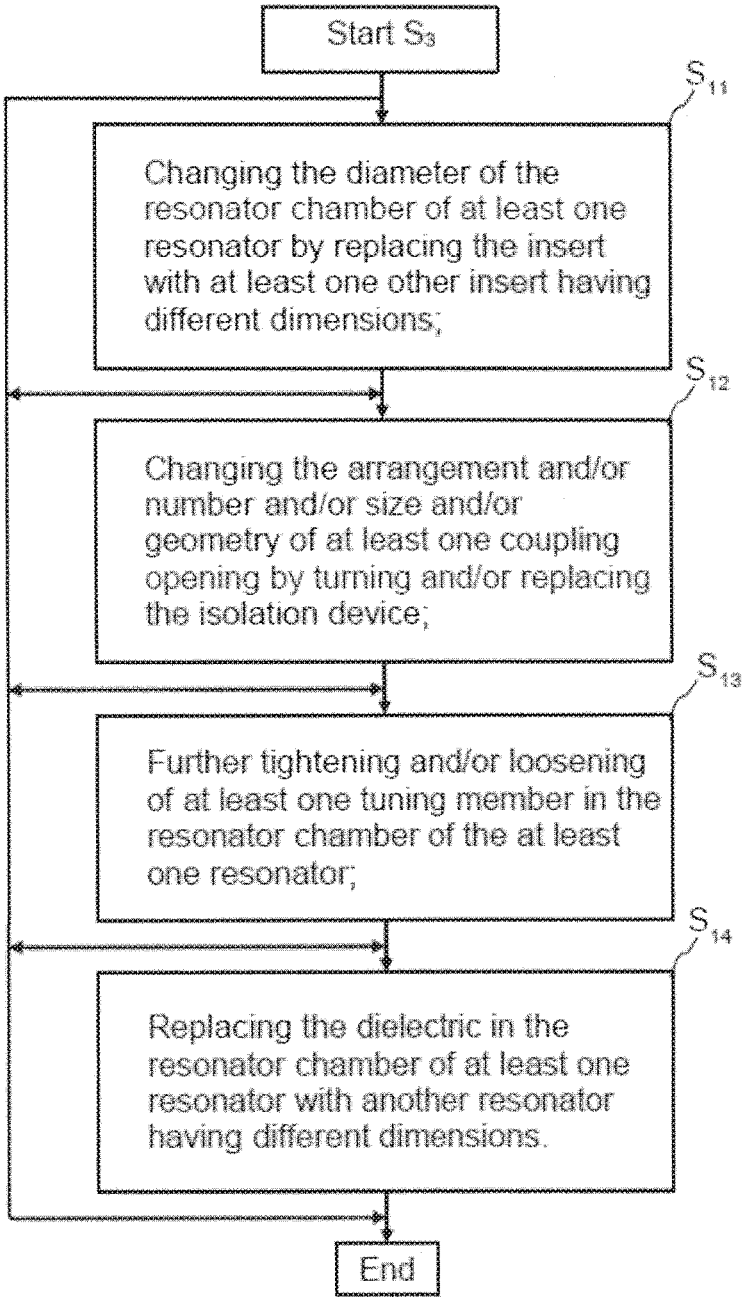
FIG. 14 another flow chart, which illustrates by means of which measures the resonant frequency and/or the coupling bandwidth can be changed within a resonator.

FIG. 14 shows another flow chart, which illustrates which measures can be used to alter the resonant frequency and/or the coupling bandwidth in a resonator $\mathbf{6}_1, \mathbf{6}_2, \ldots, \mathbf{6}_n$. During the process step $S_3$, the following process steps may be carried out individually or in combination with one another. The process step $S_{11}$ describes how the resonant frequency and/or the coupling bandwidth can be adjusted by varying the diameter of the respective resonator chamber $\mathbf{7}_1, \mathbf{7}_2, \ldots, \mathbf{7}_n$ by replacing the insert $\mathbf{11}_1, \mathbf{11}_2, \ldots, \mathbf{11}_n$ with another insert having different dimensions, in particular having a different inside diameter.

Process step $S_{12}$ can be carried out as an alternative or in addition to process step $S_{11}$. During the process step $S_{12}$, an isolation device $\mathbf{9}_1, \mathbf{9}_2, \ldots, \mathbf{9}_{n-1}$ that has been provided can be rotated so that the coupling openings 10 are arranged differently. It is also possible for the isolation device $\mathbf{9}_1, \mathbf{9}_2, \ldots, \mathbf{9}_n$ to be replaced by another isolation device, so that the coupling openings 10 have a different arrangement and/or a different number and/or a different size and/or a different geometry.

Optionally and/or in addition to the process steps $S_{11}$ and/or $S_{12}$, the process step $S_{13}$ may be carried out. A change in the resonant frequency and/or the coupling bandwidth may also take place by further screwing in and/or unscrewing at least one tuning element $\mathbf{40}_1, \mathbf{40}_2, \ldots, \mathbf{40}_n$ out of the respective resonator chamber $\mathbf{7}_1, \mathbf{7}_2, \ldots, \mathbf{7}_n$. More than one tuning element $\mathbf{40}_1, \mathbf{40}_2, \ldots, \mathbf{40}_n$ may also be screwed into or out of a resonator chamber $\mathbf{7}_1, \mathbf{7}_2, \ldots, \mathbf{7}_n$.

The process step $S_{14}$ may also be carried out in addition or as an alternative to the process steps $S_{11}$, $S_{12}$ and/or $S_{13}$. During the process step $S_{14}$, at least one dielectric $\mathbf{8}_1, \mathbf{8}_2, \ldots, \mathbf{8}_n$ in a resonator chamber $\mathbf{7}_1, \mathbf{7}_2, \ldots, \mathbf{7}_n$ may be replaced by a dielectric $\mathbf{8}_1, \mathbf{8}_2, \ldots, \mathbf{8}_n$ which has different dimensions, in particular a different height and/or diameter.

During the process step $S_1$ or each time when coupling openings 10 are to be closed, this preferably takes place by the fact that the respective isolation device $\mathbf{9}_1, \mathbf{9}_2, \ldots, \mathbf{9}_n$ is replaced by one which has no coupling openings 10.

The invention is not limited to the exemplary embodiments described here. All the features described and/or illustrated here may be combined with one another in any way within the scope of the invention.

The invention claimed is:

1. A high-frequency filter having a housing, comprising:

at least n resonators, each of which comprises a resonator chamber surrounded by the housing, where n≥2, the resonator chambers of the at least n resonators being arranged next to one another in a direction of signal transmission, which is perpendicular to an H field;

at least n dielectrics, at least one of which is arranged in a resonator chamber of the at least n resonators;

n−1 isolation devices, wherein each resonator chamber is adjacent to at most two other resonator chambers and is isolated from each of them by a corresponding isolation device;

each of the n−1 isolation devices having at least one coupling opening through which the adjacent resonator chambers are coupled to one another;

the coupling between the resonator chambers taking place at a right angle or with one component predominantly at a right angle to the H field;

a first signal line terminal being coupled to the at least one dielectric through a first opening in the housing of the first resonator; and a) the dielectric in the resonator chamber of the first resonator of the at least n resonators has an indentation into which the first signal line terminal protrudes; or b) the dielectric in the resonator chamber of the first resonator has a continuous recess through which the first signal line terminal extends, so that the first signal line terminal is in contact with the first isolation device; and/or a second signal line terminal is coupled to the dielectric of the $n^{th}$ resonator through a second opening in the housing; and a) the dielectric in the resonator chamber of the $n^{th}$ resonator has an indentation into which the second signal line terminal protrudes; or b) the dielectric in the resonator chamber of the $n^{th}$ resonator has a continuous recess through which the second signal line terminal extends, so that the second signal line terminal is in contact with the $n-1^{th}$ isolation device.

2. The high-frequency filter according to claim 1, wherein:

each of the n−1 isolation devices consists of an isolation plate, which is made of metal and/or a metal alloy or comprises metal and/or a metal alloy; or one or two front faces of each of the n dielectrics is coated with a metal layer, wherein the metal layer then represents one of the n−1 isolation devices, wherein the at least one dielectric is designed in one piece with the at least one of the n−1 isolation devices and wherein at least one recess in the coating of the metal layer forms the at least one coupling opening.

3. The high-frequency filter according to claim 1, wherein:

the at least n resonators are arranged in the signal transmission direction and/or along a central axis, wherein the H field extends radially outward around the central axis and/or around the signal transmission direction.

4. The high-frequency filter according to claim 1, wherein:

at least one of the resonator chambers and/or one of the dielectrics is cylindrical in shape.

5. The high-frequency filter according to claim 1, wherein:

the first signal line terminal, which engages in the indentation or in the continuous recess in the dielectric in the resonator chamber of the first resonator, is in contact with the dielectric or is arranged without contact with the dielectric; and/or the first signal line terminal, which engages in the indentation or in the continuous recess in the dielectric in the resonator chamber of the $n^{th}$ resonator, is in contact with the dielectric or is arranged without contact with the dielectric.

6. The high-frequency filter according to claim 5, wherein:

the housing comprises a housing bottom and a housing cover at a distance from the housing bottom;

between the housing bottom and the housing cover:

a) a peripheral housing wall is arranged; or b) at least one insert and a peripheral housing wall is arranged, wherein the at least one insert is surrounded by the peripheral housing wall; or c) at least one insert is arranged, forming a housing wall.

7. The high-frequency filter according to claim 6, wherein:

a diameter of at least one resonator chamber of the at least n resonators is defined and/or predetermined by at least one annular insert, which is in contact with the housing wall; and/or at least one twist preventing element is mounted between at least one of the n−1 isolation devices and the at least one insert and/or the adjacent dielectric and prevents mutual twisting thereof; and/or at least one twist preventing element is mounted between the housing bottom and/or the housing cover and/or the housing wall and the insert in the first resonator chamber and the insert of the $n^{th}$ resonator chamber and thus prevents mutual twisting thereof.

8. The high-frequency filter according to claim 7, wherein:

the insert of at least two of the at least n resonators that are not directly adjacent to one another have an opening;

the at least two openings are interconnected by a duct, wherein the duct runs at least partially inside the housing wall;

an electrical conductor runs inside the duct;

the electrical conductor couples the at least two resonators capacitively and/or inductively to one another.

9. The high-frequency filter according to claim 6, wherein:

the dielectric of the first resonator is in contact with the first isolation device in the first resonator and the dielectric in the $n^{th}$ resonator is in contact with the $n-1^{th}$ isolation device and/or the dielectrics of the other n−2 resonators are in contact with both isolation devices adjacent to the respective resonator chamber; and/or the dielectric in the first resonator is in contact with the housing cover and the dielectric in the $n^{th}$ resonator is in contact with the housing body; and/or the dielectrics of the at least n resonators are fixed connected by soldering or pressing to one or both isolation devices which are adjacent to the respective resonator chamber.

10. The high-frequency filter according to claim 1, wherein:

the at least n dielectrics are disk-shaped; and/or at least two or all of the at least n dielectrics differ in their material; and/or at least two or all of the at least n dielectrics are completely or partially different in their dimensions; and/or all or at least one of the at least n dielectrics completely or partially fill up a volume of the resonator chamber of their respective n resonators.

11. The high-frequency filter according to claim 1, wherein:

an arrangement and/or a size and/or a cross-sectional shape of at least one coupling opening of one of the n−1 isolation devices is completely or partially different from an arrangement and/or a size and/or a cross-sectional shape of a coupling opening of another one of the n−1 isolation devices; and/or a number of coupling openings in the n−1 isolation devices is completely or partially different.

12. A high-frequency filter having a housing, comprising:

at least n resonators, each of which comprises a resonator chamber surrounded by the housing, where n>2, the resonator chambers of the at least n resonators being arranged next to one another in a direction of signal transmission, which is perpendicular to an H field;

at least n dielectrics, at least one of which is arranged in a resonator chamber of the at least n resonators;

n−1 isolation devices, wherein each resonator chamber is adjacent to at most two other resonator chambers and is isolated from each of them by a corresponding isolation device; each of the n−1 isolation devices having at least one coupling opening through which the adjacent resonator chambers are coupled to one another;

the coupling between the resonator chambers taking place at a right angle or with one component predominantly at a right angle to the H field;

a first signal line terminal being coupled to the at least one dielectric through a first opening in the housing of the first resonator; and a) the first signal line terminal is in central or eccentric contact with the dielectric in the resonator chamber of the first resonator; or b) the dielectric in the resonator chamber of the first resonator of the at least n resonators has an indentation into which the first signal line terminal protrudes; or c) the dielectric in the resonator chamber of the first resonator has a continuous recess through which the first signal line terminal extends, so that the first signal line terminal is in contact with the first isolation device; and/or a second signal line terminal is coupled to the dielectric of the nth resonator through a second opening in the housing; and a) the second signal line terminal is in central or eccentric contact with the dielectric in the resonator chamber of the nth resonator; or b) the dielectric in the resonator chamber of the $n^{th}$ resonator has an indentation into which the second signal line terminal protrudes; or c) the dielectric in the resonator chamber of the $n^{th}$ resonator has a continuous recess through which the second signal line terminal extends, so that the second signal line terminal is in contact with the $n-1^{th}$ isolation device, wherein:

an arrangement and/or a size and/or a cross-sectional shape of at least one coupling opening of one of the n−1 isolation devices is completely or partially different from an arrangement and/or a size and/or a cross-sectional shape of a coupling opening of another one of the n−1 isolation devices; and/or a number of coupling openings in the n−1 isolation devices is completely or partially different.

13. The high-frequency filter according to claim 12, wherein:

the first signal line terminal, which engages in an indentation or in a continuous recess in the dielectric in the resonator chamber of the first resonator, is in contact with the dielectric or is arranged without contact with the dielectric; and/or the first signal line terminal, which engages in the indentation or in the continuous recess in the dielectric in the resonator chamber of the nth resonator, is in contact with the dielectric or is arranged without contact with the dielectric.

14. The high-frequency filter according to claim 13, wherein:

the housing comprises a housing bottom and a housing cover at a distance from the housing bottom;

between the housing bottom and the housing cover:

a) a peripheral housing wall is arranged; or b) at least one insert and a peripheral housing wall is arranged, wherein the at least one insert is surrounded by the peripheral housing wall; or c) at least one insert is arranged, forming a housing wall.

15. The high-frequency filter according to claim 14, wherein:

a diameter of at least one resonator chamber of the at least n resonators is defined and/or predetermined by at least one annular insert, which is in contact with the housing wall; and/or at least one twist preventing element is mounted between at least one of the n−1 isolation devices and the at least one insert and/or the adjacent dielectric and prevents mutual twisting thereof; and/or at least one twist preventing element is mounted between the housing bottom and/or the housing cover and/or the housing wall and the insert in the first resonator chamber and the insert of the nth resonator chamber and thus prevents mutual twisting thereof.

16. The high-frequency filter according to claim 14, wherein:

the dielectric of the first resonator is in contact with the first isolation device in the first resonator and the dielectric in the nth resonator is in contact with the $n-1^{th}$ isolation device and/or the dielectrics of the other n−2 resonators are in contact with both isolation devices adjacent to the respective resonator chamber; and/or the dielectric in the first resonator is in contact with the housing cover and the dielectric in the nth resonator is in contact with the housing body; and/or the dielectrics of the at least n resonators are fixed connected by soldering or pressing to one or both isolation devices which are adjacent to the respective resonator chamber.

17. The high-frequency filter according to claim 12, wherein:

the at least n resonators are arranged in the signal transmission direction and/or along a central axis, wherein the H field extends radially outward around the central axis and/or around the signal transmission direction.

18. The high-frequency filter according to claim 12, wherein:

at least one of the resonator chambers and/or one of the dielectrics is cylindrical in shape.

* * * * *